US008087189B2

(12) United States Patent
Bobbett et al.

(10) Patent No.: US 8,087,189 B2
(45) **Date of Patent: *Jan. 3, 2012**

(54) CHEMICALLY-TREATED OUTSOLE ASSEMBLY FOR A GOLF SHOE

(75) Inventors: Jon Bobbett, Portsmouth, NH (US); Michael Roy, Kowloon (HK); James Gorman, Hopkington, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/961,265

(22) Filed: Dec. 6, 2010

(65) Prior Publication Data

US 2011/0072687 A1 Mar. 31, 2011

Related U.S. Application Data

(63) Continuation of application No. 11/952,015, filed on Dec. 6, 2007, now Pat. No. 7,845,097.

(60) Provisional application No. 60/869,046, filed on Dec. 7, 2006.

(51) Int. Cl.

| | |
|---|---|
| ***A43B 5/00*** | (2006.01) |
| ***A43B 13/02*** | (2006.01) |
| ***C08G 18/28*** | (2006.01) |
| ***C08G 18/48*** | (2006.01) |

(52) U.S. Cl. ..... 36/127; 36/25 R; 36/103; 525/457; 525/458

(58) Field of Classification Search ..... 36/127, 36/25 R, 103, 30 R, 31, 98; 525/457, 458; 12/142 R, 142 P See application file for complete search history.

(56) References Cited

U.S. PATENT DOCUMENTS

| | | | | |
|---|---|---|---|---|
| 4,679,795 | A | 7/1987 | Melvin et al. | |
| 4,884,814 | A | 12/1989 | Sullivan | |
| 4,911,451 | A | 3/1990 | Sullivan et al. | |
| 4,986,545 | A | 1/1991 | Sullivan | |
| 5,098,105 | A | 3/1992 | Sullivan | |
| 5,187,013 | A | 2/1993 | Sullivan | |
| 5,312,857 | A | 5/1994 | Sullivan | |
| 5,484,870 | A | 1/1996 | Wu | |
| 5,688,869 | A | 11/1997 | Sullivan | |
| 5,932,336 | A * | 8/1999 | Allen et al. | 428/315.5 |
| 5,987,783 | A * | 11/1999 | Allen et al. | 36/127 |
| 6,210,293 | B1 | 4/2001 | Sullivan | |
| 6,294,617 | B1 | 9/2001 | Rajagopalan | |
| 6,309,706 | B2 | 10/2001 | Maruoka et al. | |
| 6,413,172 | B1 | 7/2002 | Binette | |
| 6,569,037 | B2 | 5/2003 | Ichikawa et al. | |
| 6,645,091 | B2 | 11/2003 | Wu et al. | |
| 6,762,273 | B2 | 7/2004 | Dewanjee | |
| 6,855,076 | B2 | 2/2005 | Matroni et al. | |
| 6,935,970 | B2 | 8/2005 | Matroni et al. | |
| 7,219,446 | B1 * | 5/2007 | Haimerl | 36/12 |
| 2001/0022039 | A1 * | 9/2001 | Krajcir | 36/72 R |
| 2002/0053148 | A1 * | 5/2002 | Haimerl | 36/55 |
| 2002/0144431 | A1 * | 10/2002 | Knoerr | 36/31 |
| 2003/0024134 | A1 * | 2/2003 | Howlett et al. | 36/43 |
| 2005/0241186 | A1 * | 11/2005 | Mulligan et al. | 36/43 |
| 2006/0141228 | A1 * | 6/2006 | Rearick et al. | 428/212 |

* cited by examiner

*Primary Examiner* — Jila Mohandesi
(74) *Attorney, Agent, or Firm* — Michael A. Catania; Rebecca Hanovice; Sonia Lari

(57) ABSTRACT

An out-sole assembly for a golf shoe. The outsole assembly includes an internal base member composed of EVA, an inner frame member composed thermoplastic polyurethane subjected to an isocyanate solution, an external base member composed of a thermoplastic polyurethane, a dual looping frame composed of a thermoplastic polyurethane, and a plurality of spike members.

7 Claims, 14 Drawing Sheets

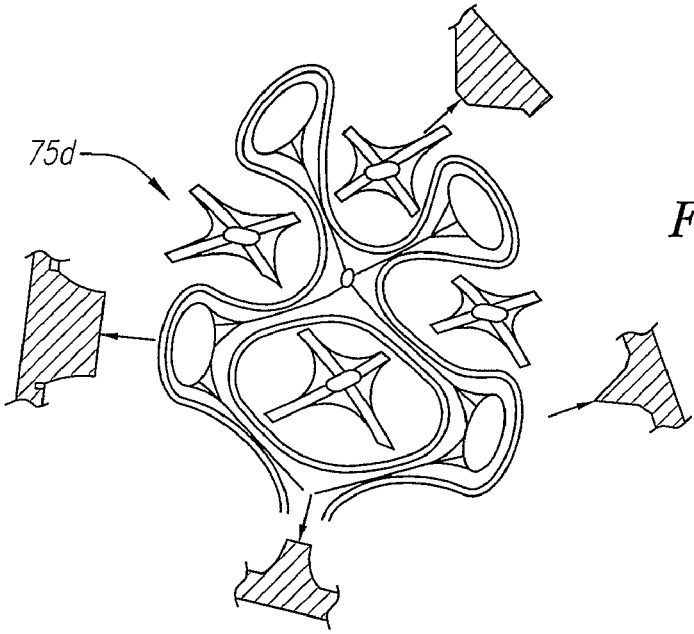
FIG. 22
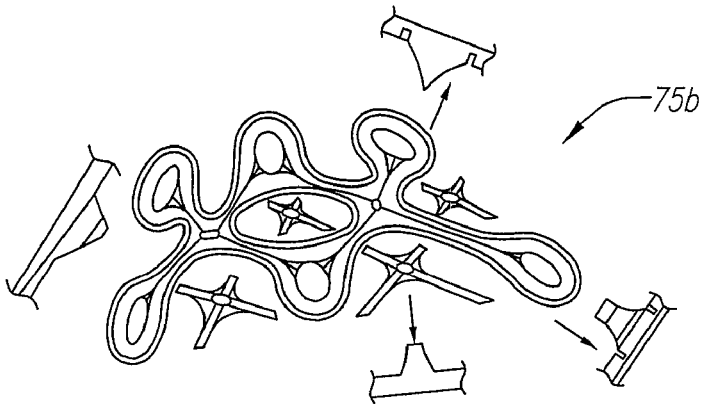
FIG. 23
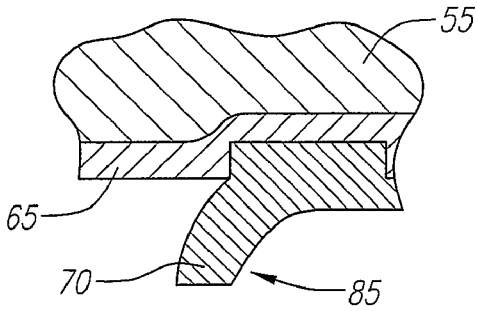
FIG. 24
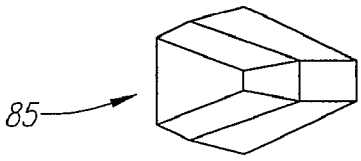

CHEMICALLY-TREATED OUTSOLE ASSEMBLY FOR A GOLF SHOE

CROSS REFERENCES TO RELATED APPLICATIONS

The present application is a continuation application of U.S. patent application Ser. No. 11/952,015, filed on Dec. 6, 2007, which claims priority to U.S. Provisional Patent Application No. 60/869,046, filed on Dec. 7, 2006, now abandoned.

STATEMENT REGARDING FEDERALLY SPONSORED RESEARCH OR DEVELOPMENT

Not Applicable

BACKGROUND OF THE INVENTION

1. Field of the Invention

The present invention relates to golf shoes. More specifically, the present invention relates to an outsole assembly for a golf shoe.

2. Description of the Related Art

The traction portion of a golf shoe is subject to tremendous wear and tear during a round of golf. Typically, spikes composed of a polymer materials should be replaced after ten rounds of golf.

Erickson et al., U.S. Pat. No. 6,708,426 for a Torsion Management Outsoles And Shoes Including Such Outsoles discloses an outsole with a forward portion and a rearward portion connected by a ball-and-socket connection to allow the forward portion and rearward portion to flex freely.

Allen et al., U.S. Pat. No. 5,987,783, for a Golf Shoe Having Spike Socket Spine System, discloses a golf shoe with a spike frame that receives spike receptacles and is embedded within the outsole.

Robinson et al., U.S. Pat. No. 5,979,083, for a Multi-Layer Outsole, discloses a two-layers outsole for a golf shoe with the layers formed from thermoplastic polyurethane.

Robinson et al., U.S. Pat. No. 7,143,529, for a Torsion Management Outsoles And Shoes Including Such Outsoles, discloses an outsole with a forward portion and a rearward portion connected by a ball-and-socket connection to allow the forward portion and rearward portion to flex freely, and also includes a gel cushion.

There is a need for a better outsole assembly.

BRIEF SUMMARY OF THE INVENTION

An out-sole assembly for a golf shoe having improved durability and dynamic flexibility is disclosed herein. The out-sole assembly has components that are subjected to an isocyanate solution for added durability.

One aspect of the present invention is an outsole assembly for a golf shoe. The outsole assembly includes an internal base member composed of EVA, an inner frame member composed thermoplastic polyurethane subjected to an isocyanate solution, an external base member composed of a thermoplastic polyurethane, a dual looping frame composed of a thermoplastic polyurethane, and a plurality of spike members.

Another aspect of the present invention is a golf shoe. The golf shoe includes an internal base member, an inner frame member, an external base member, a dual looping frame, and a plurality of spike members. At least one of the components above is molded from a thermoplastic material comprising a polyurethane, polyurea or polyurethane/polyurea composition having a melt index of 15 g/10 min or more at a temperature of 200° C. to 210° C. and a load of 8.7 kg prior to molding, and the component is treated with a secondary curing agent comprising an isocyanate subsequent to molding.

Alternatively, all of the components are molded from a thermoplastic material comprising a polyurethane, polyurea or polyurethane/polyurea composition having a melt index of 15 g/10 min or more at a temperature of 200° C. to 210° C. and a load of 8.7 kg prior to molding, and the component is treated with a secondary curing agent comprising an isocyanate subsequent to molding.

Yet another aspect of the present invention is a golf shoe having a component composed of a certain material. The golf shoe includes an internal base member, an inner frame member, an external base member, a dual looping frame, and a plurality of spike members. At least one of the components above has a Shore D hardness of 60 or less and is molded from a thermoplastic material comprising a polyurethane, polyurea or polyurethane/polyurea composition having a flex modulus of 30,000 psi or less and a melt index of 15 g/10 min or more at a temperature of 200° C. to 210° C. and a load of 8.7 kg prior to molding, and the component is treated with a secondary curing agent comprising an isocyanate subsequent to molding.

Alternatively, all of the components have a Shore D hardness of 60 or less and is molded from a thermoplastic material comprising a polyurethane, polyurea or polyurethane/polyurea composition having a flex modulus of 30,000 psi or less and a melt index of 15 g/10 min or more at a temperature of 200° C. to 210° C. and a load of 8.7 kg prior to molding, and the component is treated with a secondary curing agent comprising an isocyanate subsequent to molding.

Having briefly described the present invention, the above and further objects, features and advantages thereof will be recognized by those skilled in the pertinent art from the following detailed description of the invention when taken in conjunction with the accompanying drawings.

BRIEF DESCRIPTION OF THE SEVERAL VIEWS OF THE DRAWINGS

FIG. 22 is an isolated view of a spike member with partial cross-sectional views.

FIG. 23 is an isolated view of a spike member with partial cross-sectional views.

FIG. 24 is an isolated view of a tooth of the plurality of teeth of the dual loop member of the out-sole assembly of the present invention along with a partial cross-sectional view.

DETAILED DESCRIPTION OF THE INVENTION

Figure 1:
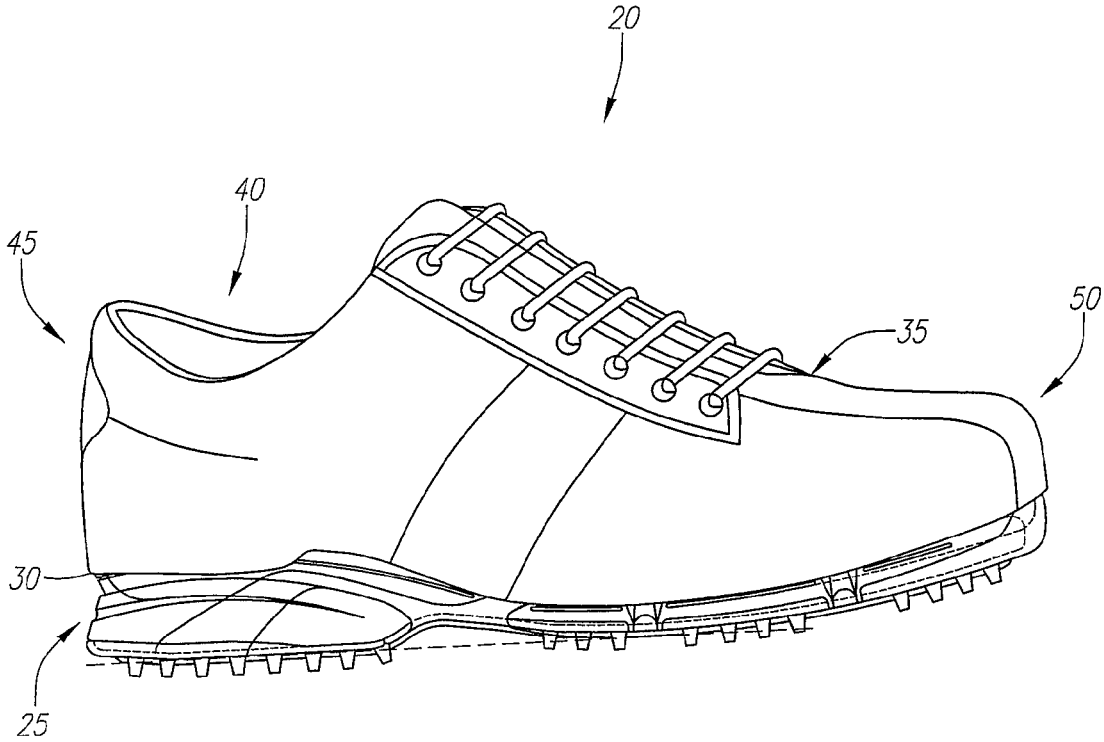
FIG. 1 is a top perspective view of a golf shoe of the present invention.
Figure 2:
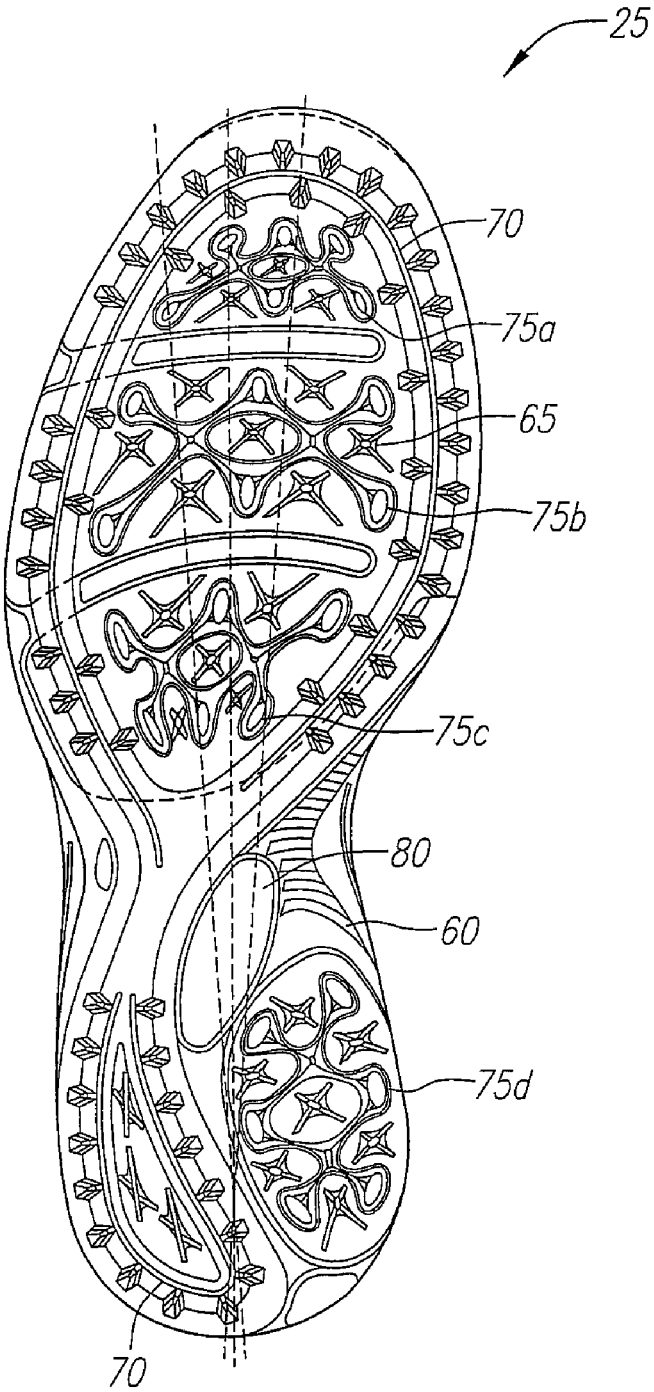
FIG. 2 is a bottom view of a out-sole assembly of the present invention.
Figure 3:
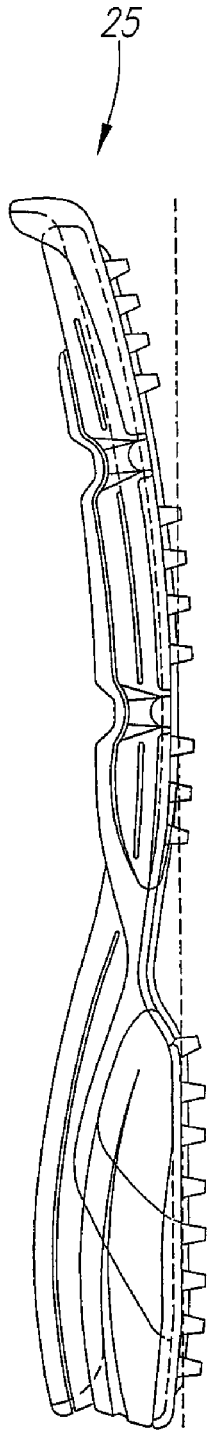
FIG. 3 is a medial view of the out-sole assembly of FIG. 2.
Figure 4:
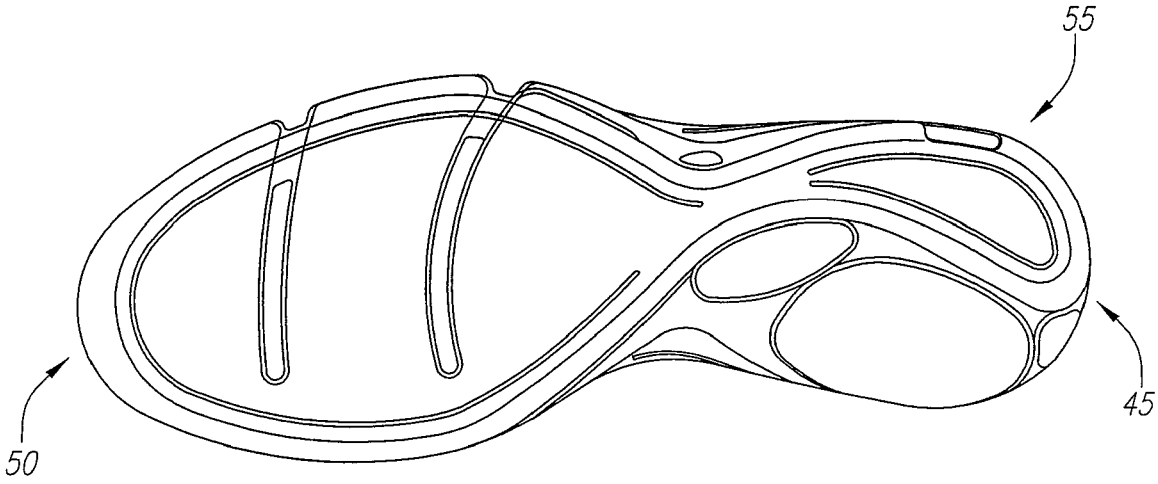
FIG. 4 is an isolated view of an internal base member of the out-sole assembly of the present invention.
Figure 5:
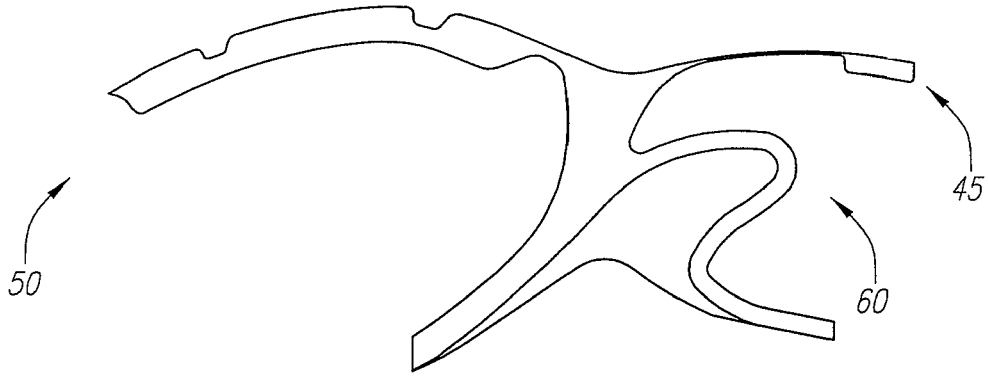
FIG. 5 is an isolated view of an inner frame member of the out-sole assembly of the present invention.
Figure 6:
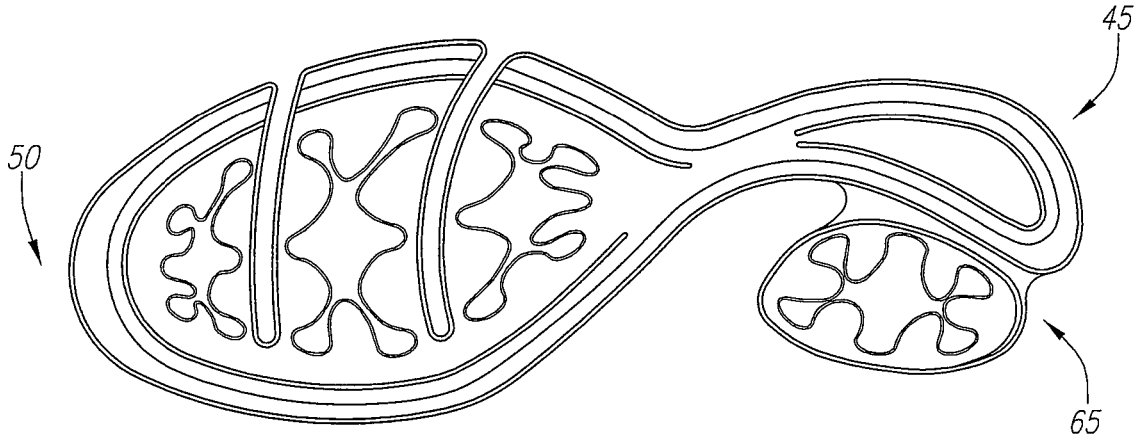
FIG. 6 is an isolated view of an external base member of the out-sole assembly of the present invention.
Figure 7:
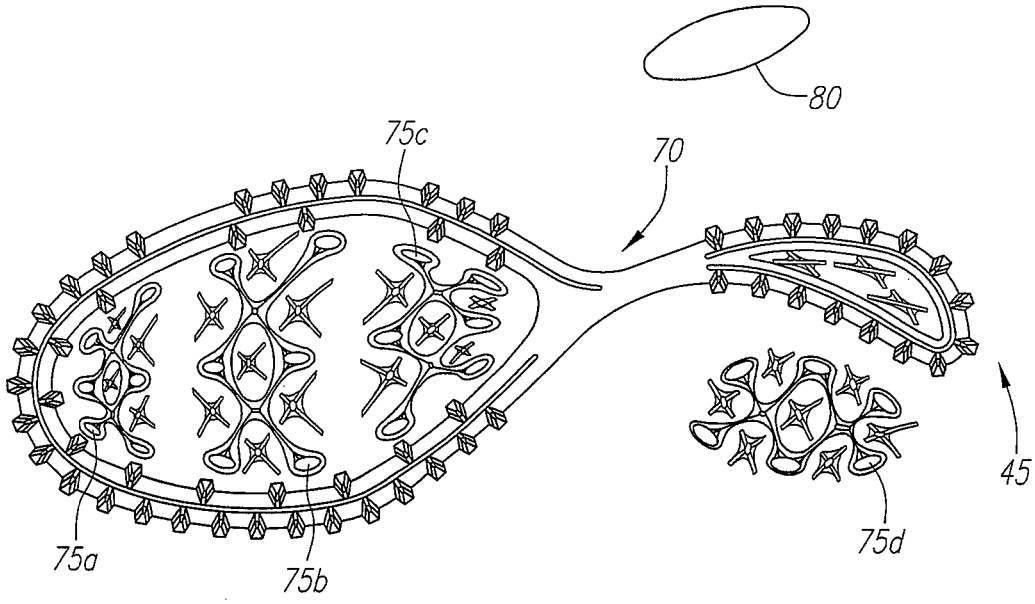
FIG. 7 is an isolated view of a dual looping member, spike members and logo medallion of the out-sole assembly of the present invention.
Figure 8:
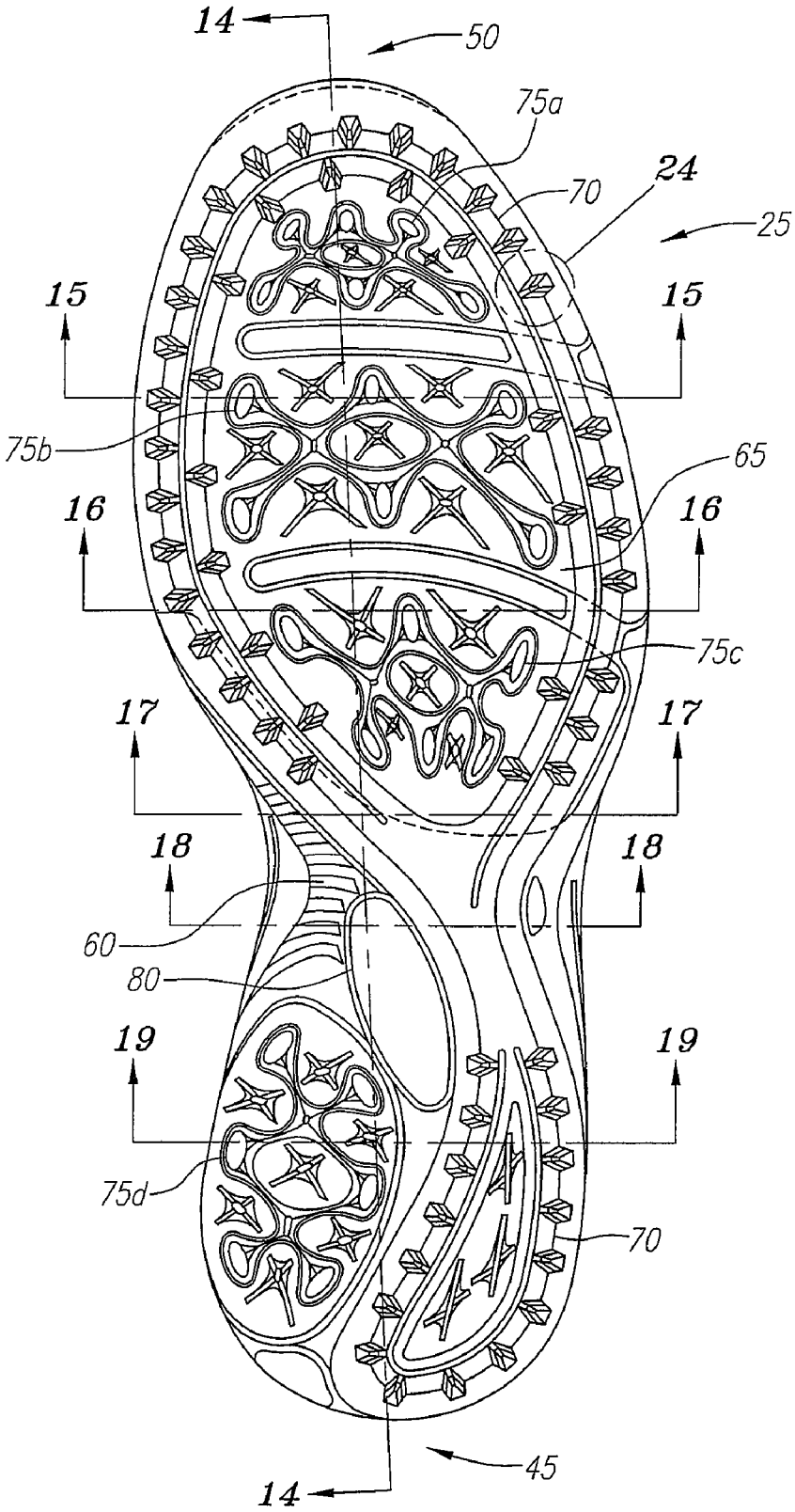
FIG. 8 is a bottom view of a out-sole assembly of the present invention.
Figure 9:
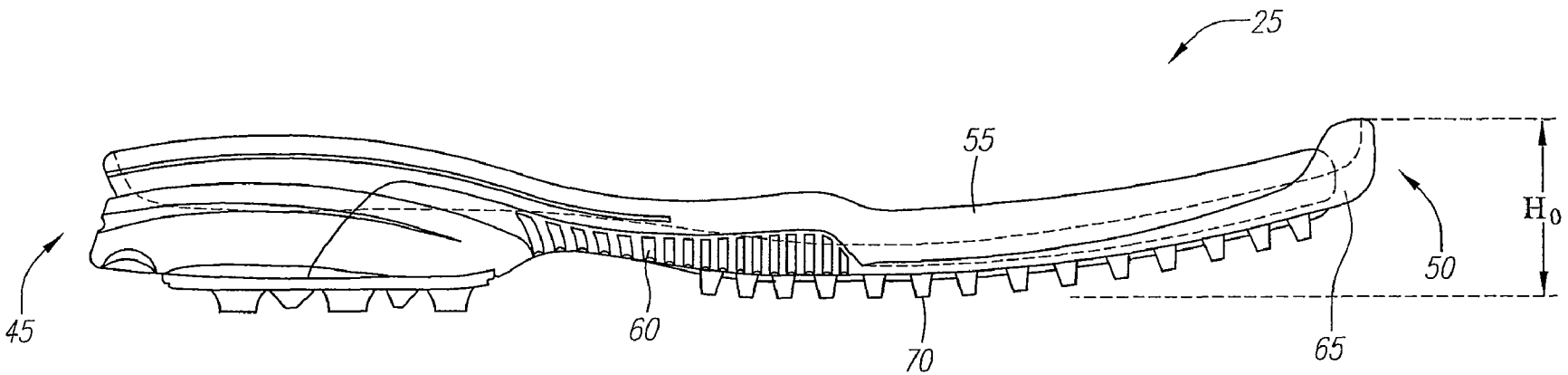
FIG. 9 is a medial view of the out-sole assembly of FIG. 8.
Figure 10:
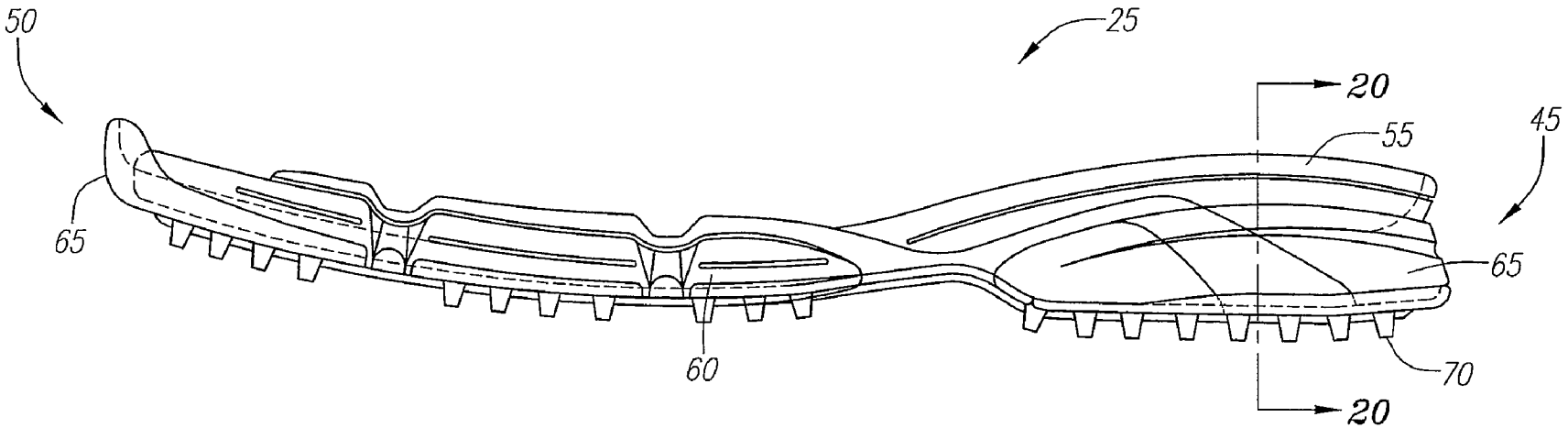
FIG. 10 is a lateral view of the out-sole assembly of FIG. 8.
Figure 11:
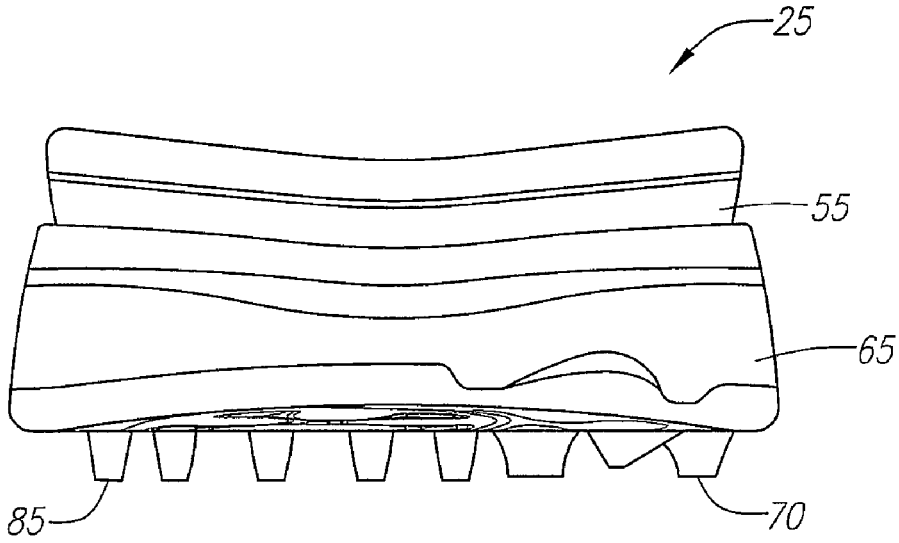
FIG. 11 is a heel end view of the out-sole assembly of FIG. 8.
Figure 12:
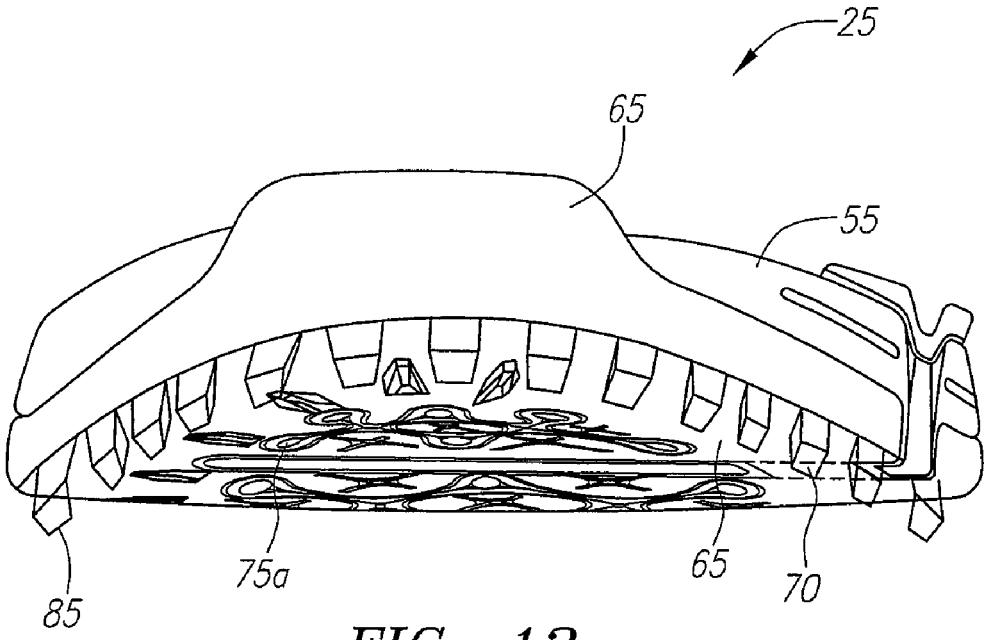
FIG. 12 is a toe end view of the out-sole assembly of FIG. 8.
Figure 13:
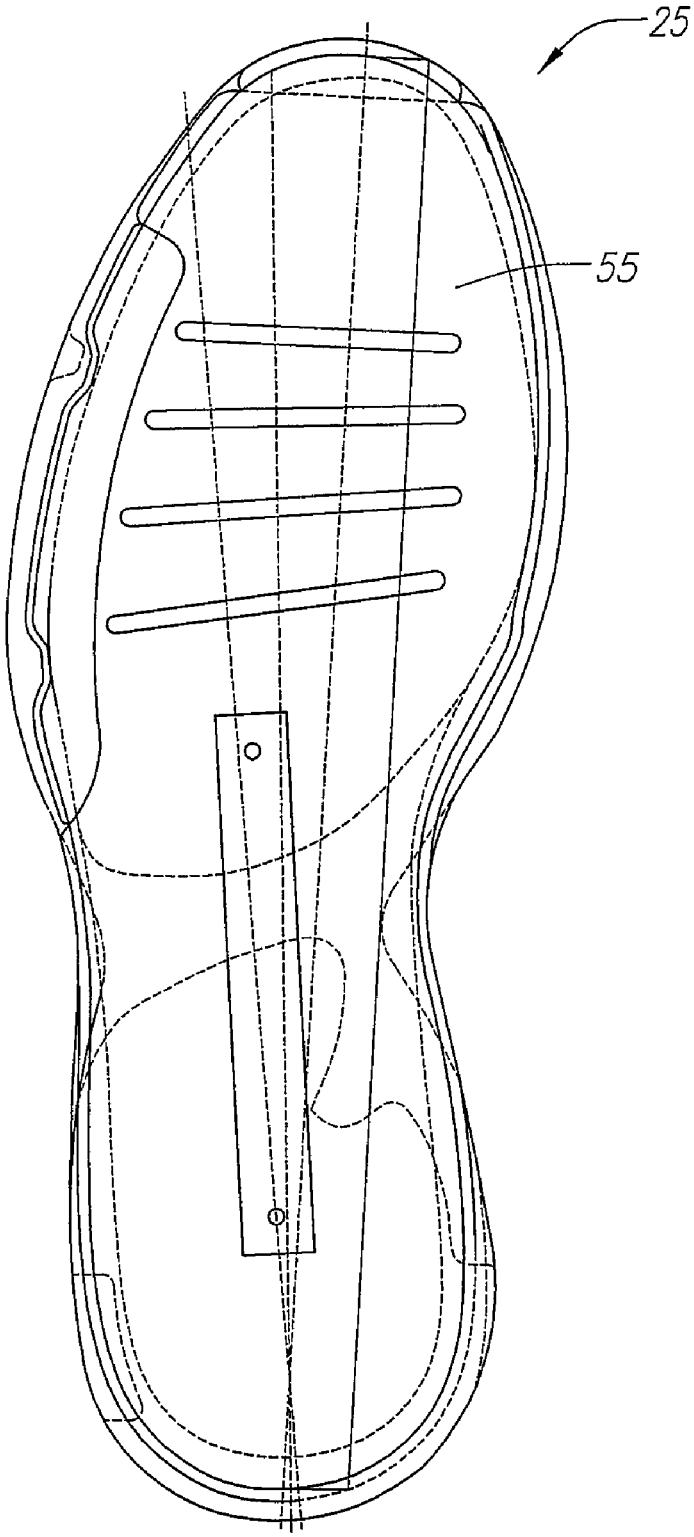
FIG. 13 is a top plan view of the out-sole assembly of FIG. 8.
Figure 14:
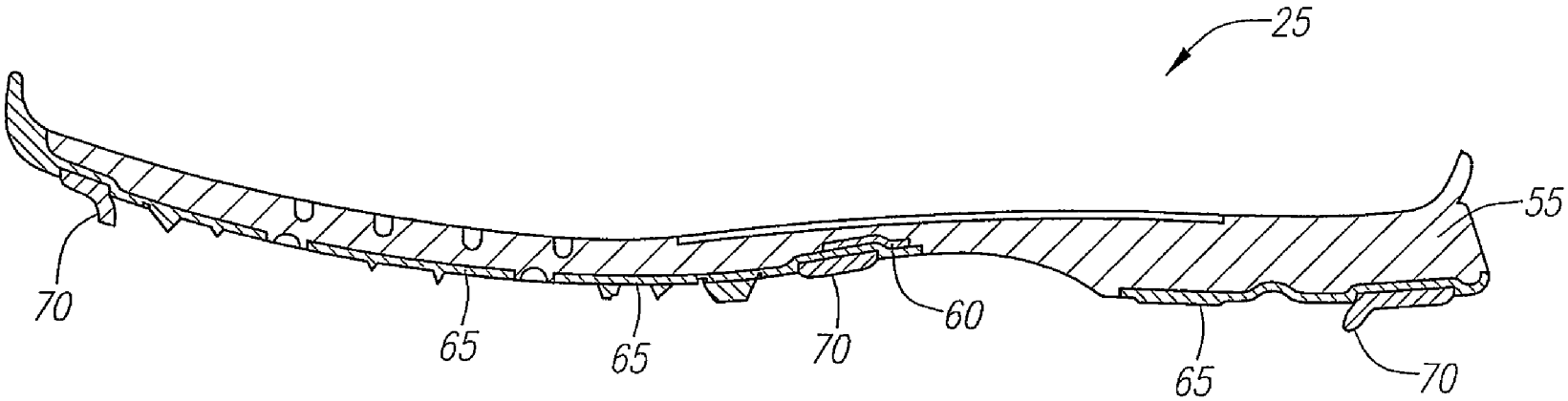
FIG. 14 is a cross-sectional view of the out-sole assembly of FIG. 8 along line 14-14.
Figure 15:
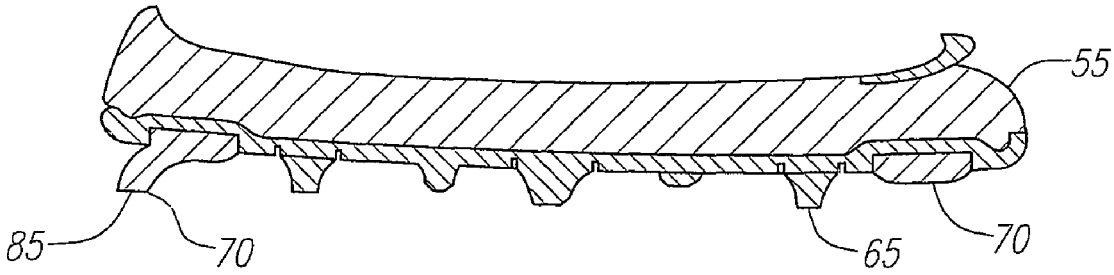
FIG. 15 is a cross-sectional view of the out-sole assembly of FIG. 8 along line 15-15.
Figure 16:
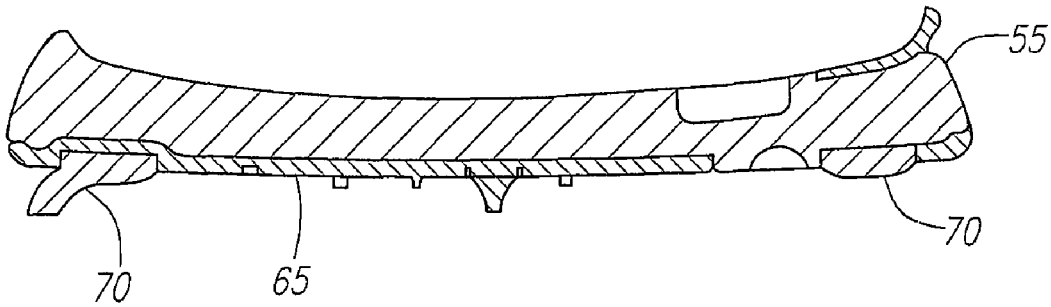
FIG. 16 is a cross-sectional view of the out-sole assembly of FIG. 8 along line 16-16.
Figure 17:
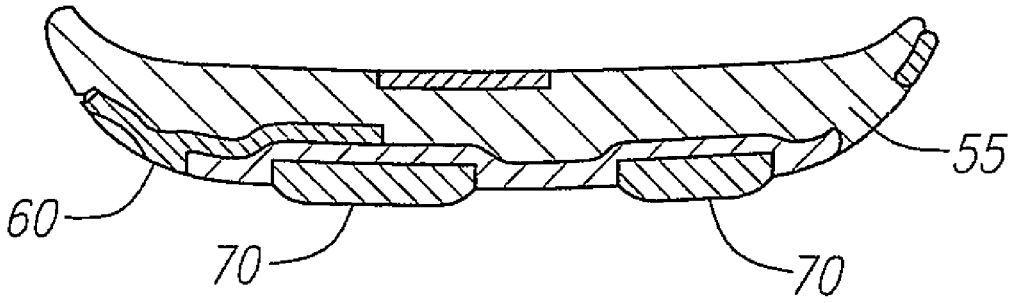
FIG. 17 is a cross-sectional view of the out-sole assembly of FIG. 8 along line 17-17.
Figure 18:
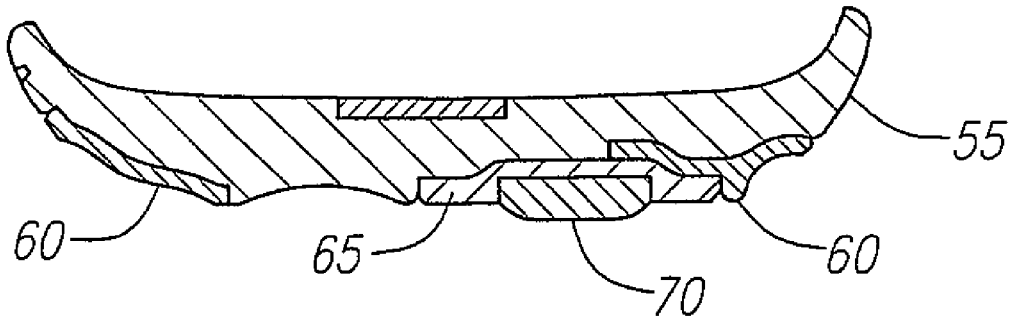
FIG. 18 is a cross-sectional view of the out-sole assembly of FIG. 8 along line 18-18.
Figure 19:
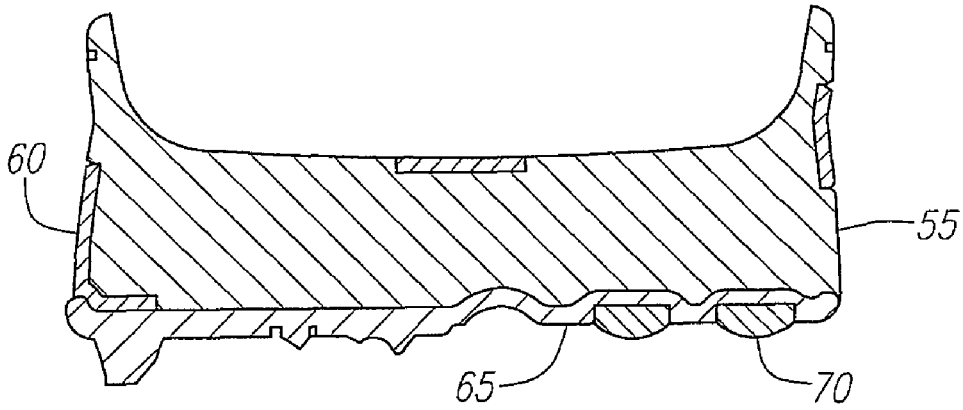
FIG. 19 is a cross-sectional view of the out-sole assembly of FIG. 8 along line 19-19.
Figure 20:
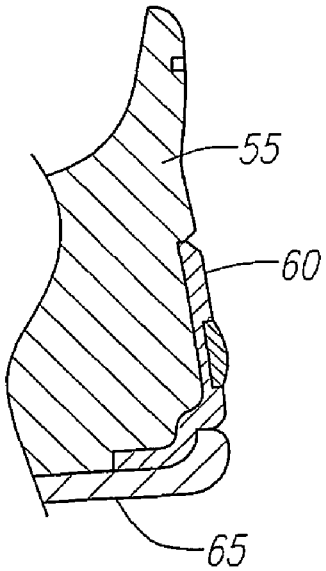
FIG. 20 is a cross-sectional view of the out-sole assembly of FIG. 8 along line 20-20.
Figure 21:
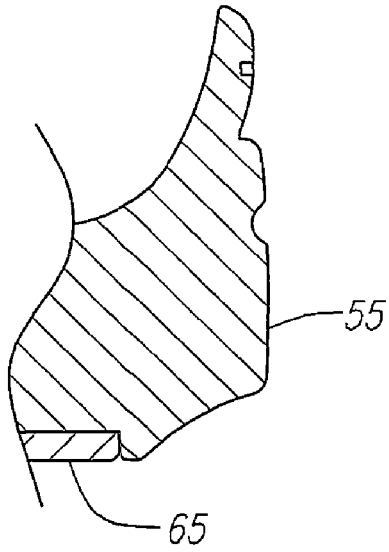
FIG. 21 is a cross-sectional view of the out-sole assembly of FIG. 8 along line 21-21.

As shown in FIG. 1, a golf shoe is generally designated 20. The golf shoe 20 preferably comprises an out-sole assembly 25, a mid-sole 30, an upper 35 with an opening 40. The golf shoe 20 also has a heel end 45 and a toe end 50.

As shown in FIGS. 2-7, the out-sole assembly 25 of the present invention comprises an internal base member 55, an inner frame member 60, an external base member 65, a dual looping frame member 70 and a plurality of spike members 75*a*, 75*b*, 75*c* and 75*d*. The out-sole assembly 25 optionally comprises a logo medallion 80. The dual looping frame 70 comprises a plurality of traction teeth 85.

A height, Ho, of the out-sole assembly preferably ranges from 30 mm to 50 mm, and is most preferably 39 mm. The thickness of the external base member 65 is preferably between 2 mm and 5 mm, and most preferably 3 mm. The thickness of the internal base member 55 preferably ranges from 5 mm to 30 mm. The height of each of the teeth 85 is preferably between 1 mm and 6 mm, and most preferably 4 mm.

In a preferred embodiment, the internal base member 55 is composed of an ethylene vinyl acetate ("EVA") material. The inner frame member 60 is preferably composed of a thermoplastic polyurethane material subjected to an additional isocyanate treatment as set forth below. The external base member 65 is preferably composed of a thermoplastic polyurethane material. The dual looping frame member 70 is preferably composed of a thermoplastic polyurethane material subjected to an additional isocyanate treatment as set forth below. Each of the plurality of spike members 75*a-d* is preferably composed of a thermoplastic polyurethane material subjected to an additional isocyanate treatment as set forth below.

Along these lines, the present invention concerns the production of a thermoplastic polyurethane, polyurea or polyurethane/polyurea golf ball component wherein the melt index of polyurethane, polyurea or polyurethane/polyurea material is high (i.e., 15 g/10 min or more, preferably 20 g/10 min or more, more preferably greater than 25 grams per 10 minutes at the temperature of 200° C. to 210° C. and a load of 8.7 Kg) or substantially increased prior to molding. For example, the melt index of the material can be increased, from supplied or base material to refined or processed material, at least 10% or more, preferably 20% to 720%, more preferably 50% to 720%, and most preferably 100% or more prior to molding of the components of the out-sole assembly 25.

The enhanced melt index of the material may be achieved by secondary processing or refining steps, such as by mechanical, chemical or electrical means. Preferably, the melt index is increased by mechanical means such as by extrusion. While not wanting to be limited to the theory of such an increase, it is believed that the melt index increases after extrusion due to a decrease in molecular weight, either by mechanical shearing or chemical changes or both. Additional processes for decreasing the molecular weight of the material can also be used. For example, other methods for decreasing the molecular weight and/or increasing the melt index of the material include the use of, or the incorporation of, heat, light, irradiation, moisture, flow additives, plasticizers, extenders, lubricants or other thermoplastic materials having a higher melt index, etc. The melt index of the material is adjusted to the high melt index range desired prior to molding.

In a further embodiment, each of the components of the out-sole assembly 25 is treated with a secondary curing or treating agent, such as a solution containing one or more isocyanates, to improve durability of the component. It is believed that the isocyanate further cross-links the material to provide additional scuff resistance while maintaining the other desirable features of the component, such as flexibility. The solution containing the isocyanate is preferably added to the material by any suitable method known in the art, although dipping, wiping, soaking, brushing or spraying the components of the out-sole assembly 25 in or with the isocyanate solution is preferred. The method of adding the isocyanate to the components of the out-sole assembly 25 is discussed in more detail below.

The solution of the isocyanate that is added to the material to improve scuff resistance can be any aliphatic or aromatic isocyanate or diisocyanate or blends thereof known in the art. The isocyanate or diisocyanate used may have a solids content in the range of about 1 to about 100 weight %, preferably about 5 to about 50 weight %, most preferably about 10 to about 30 weight %. If it is necessary to adjust the solids content, any suitable solvent that will allow penetration of the isocyanate into the polyurethane, polyurea or polyurethane/polyurea material without causing distortion may be used. Examples of suitable solvents include ketone and acetate.

In a particularly preferred aspect of the present invention, the components of the out-sole assembly 25 are formed from a thermoplastic polyurethane, polyurea or polyurethane/polyurea material having a relatively high melt index, or that which is adjusted prior to molding so as to exhibit a relatively high melt index. In this regard, the melt of the material is 25 g/10 min or more at a temperature of 200° C. to 210° C. and a load of 8.7 kg prior to molding. Preferably, the melt index of the material is of 30 g/10 min or more, more preferably 35 g/10 min or more and most preferably 40 g/10 min or more at the above noted temperature and conditions.

In accordance with the present invention, it has been discovered that the higher the melt index of a polymer, the better the flow and lower the injection molding pressures. Melt index or melt flow values referred to herein are determined (unless specified differently) in accordance with ASTM Standard D1238, herein incorporated by reference.

The previously noted preferred thermoplastic polyurethane materials may be adjusted into higher melt index materials. It is preferably to raise the melt index to allow for the molding of the components of the out-sole assembly 25. For example, Bayer TEXIN® DP7-1097 has (according to Bayer Corporation) a melt index of about 7 to 12 g/10 min at 200° C.

and 8.7 kg. The base material received from Bayer is then further processed to exhibit a melt index of from about 25 to about 45 g/10 min at 200° C. and 8.7 kg. This material, when used for forming the components of the out-sole assembly 25, preferably has an increased melt index of about 35 to about 85 g/10 min at 200° C. and 8.7 kg.

Similarly, Bayer TEXIN® 245 has (according to Bayer Corporation) a melt index of about 20 to 40 g/10 min at 230° C. and 1.2 kg. It can be further processed or refined to exhibit a melt index of about 25 to about 45 g/10 min at 210° C. and 8.7 kg.

As also noted herein, it has been discovered that as the melt index of a polymer increases, some of the physical properties of the polymer decrease. As a result, in the more preferred embodiments of the invention the high melt index of the components of the out-sole assembly 25 are further treated with a liquid isocyanate solution. By performing an isocyanate post-molding treatment process to the components of the out-sole assembly 25, the physical properties of the thermoplastic polyurethane, polyurea or polyurethane/polyurea material may not only increase, but may increase beyond the values of the non-refined material. This physical property improvement yields a significant improvement in durability, namely improved cut and scuff resistance.

This post-application of isocyanate is believed to allow for the use of relatively high melt index thermoplastic polyurethane, polyurea or polyurethanes/polyureas to be used in conventional injection molding machines and/or in reaction injection molding ("RIM") equipment to mold the components of the out-sole assembly 25. The components of the out-sole assembly 25 are preferably dipped in an isocyanate solution for 1 to 10 minutes (preferably 1 to 5 minutes); the isocyanate may be aliphatic or aromatic, such as HDI, IPDI, MDI, TDI type or others as discussed below and the isocyanate solution may range from 10 to 100% solids. The solvent used to reduce the solids and make the isocyanate solutions may be a ketone or acetate or any solvent that will allow penetration of the isocyanate into the material without distortion. After dipping, the components of the out-sole assembly 25 are preferably air-dried for 1 hour and then post-cured at 175° F. for 4 hours. After the post-cure the components of the out-sole assembly 25 may be cleaned with isopropanol to remove any excess isocyanate and then finished in a normal manner. Preferably, the isocyanate used is of the MDI type at 15-30% solids reduced with a ketone (such as MONDUR ML™ from Bayer Corporation) and dipped for 2-3 minutes. Most preferably, the solids level is about 16 to 24% (20±4). It is beneficial that the MDI remain in a liquid state at room temperature. However, this method shall not be limited to the type of polyurethane, polyurea or polyurethane/polyurea material, isocyanate used, concentration of the isocyanate solution, solvent used, dip time, or method of application described above.

In a preferred embodiment, the material of the components of the out-sole assembly 25 comprises a polyurethane, a polyurea or a blend of polyurethanes/polyureas. Polyurethanes/polyureas are polymers that are used to form a broad range of products. They are generally formed by mixing two primary ingredients during processing. For the most commonly used polyurethanes, the two primary ingredients are a polyisocyanate (for example, diphenylmethane diisocyanate monomer ("MDI") and toluene diisocyanate ("TDI") and their derivatives) and a polyol (for example, a polyester polyol or a polyether polyol). Various chain extenders, known in the art, are also commonly used.

A wide range of combinations of polyisocyanates and polyols, as well as other ingredients, are available. Furthermore, the end-use properties of polyurethanes can be controlled by the type of polyurethane utilized, such as whether the material is thermoset (cross-linked molecular structure) or thermoplastic (linear molecular structure).

Cross-linking occurs between the isocyanate groups (—NCO) and the polyol's hydroxyl end-groups (—OH), and/or with already formed urethane groups. Additionally, the end-use characteristics of polyurethanes can also be controlled by different types of reactive chemicals and processing parameters. For example, catalysts are utilized to control polymerization rates. Depending upon the processing method, reaction rates can be very quick (as in the case for some reaction injection molding systems ("RIM") or may be on the order of several hours or longer (as in several coating systems). Consequently, a great variety of polyurethanes are suitable for different end-uses.

Polyurethanes are typically classified as thermosetting or thermoplastic. A polyurethane becomes irreversibly "set" when a polyurethane prepolymer is cross-linked with a polyfunctional curing agent, such as a polyamine or a polyol. The prepolymer typically is made from polyether or polyester. Diisocyanate polyethers are typically preferred because of their hydrolytic properties.

The physical properties of thermoset polyurethanes are controlled substantially by the degree of cross-linking. Tightly cross-linked polyurethanes are fairly rigid and strong. A lower amount of cross-linking results in materials that are flexible and resilient. Thermoplastic polyurethanes have some cross-linking, but primarily by physical means. The cross-link bonds can be reversibly broken by increasing temperature, as occurs during molding or extrusion. In this regard, thermoplastic polyurethanes can be injection molded, and extruded as sheet and blow film. They can be used up to about 350° F. to 450° F. and are available in a wide range of hardnesses.

Polyurethane materials suitable for the present invention are formed by the reaction of a polyisocyanate, a polyol, and optionally one or more chain extenders. The polyol component includes any suitable polyether- or polyester-polyol. Additionally, in an alternative embodiment, the polyol component is polybutadiene diol. The chain extenders include, but are not limited, to diols, triols and amine extenders. Any suitable polyisocyanate may be used to form a polyurethane according to the present invention. The polyisocyanate is preferably selected from the group of diisocyanates including, but not limited, to 4,4'-diphenylmethane diisocyanate ("MDI"); 2,4-toluene diisocyanate ("TDI"); m-xylylene diisocyanate ("XDI"); methylene bis-(4-cyclohexyl isocyanate) ("HMDI"); hexamethylene diisocyanate ("HDI"); naphthalene-1,5,-diisocyanate ("NDI"); 3,3'-dimethyl-4,4'-biphenyl diisocyanate ("TODI"); 1,4-diisocyanate benzene ("PPDI"); phenylene-1,4-diisocyanate; and 2,2,4- or 2,4,4-trimethyl hexamethylene diisocyanate ("TMDI").

Other less preferred diisocyanates include, but are not limited to, isophorone diisocyanate ("IPDI"); 1,4-cyclohexyl diisocyanate ("CHDI"); diphenylether-4,4'-diisocyanate; p,p'-diphenyl diisocyanate; lysine diisocyanate ("LDI"); 1,3-bis(isocyanato methyl)cyclohexane; and polymethylene polyphenyl isocyanate ("PMDI").

One polyurethane component that can be used in the present invention incorporates TMXDI ("META") aliphatic isocyanate (Cytec Industries, West Paterson, N.J.). Polyurethanes based on meta-tetramethylxylylene diisocyanate (TMXDI) can provide improved gloss retention UV light stability, thermal stability, and hydrolytic stability. Additionally, TMXDI ("META") aliphatic isocyanate has demonstrated favorable toxicological properties. Furthermore, because it has a low viscosity, it is usable with a wider range of diols (to polyurethane) and diamines (to polyureas). If TMXDI is used, it typically, but not necessarily, is added as a direct replacement for some or all of the other aliphatic isocyanates in accordance with the suggestions of the supplier. Because of slow reactivity of TMXDI, it may be useful or necessary to use catalysts to have practical demolding times. Hardness, tensile strength and elongation can be adjusted by adding further materials in accordance with the supplier's instructions.

The polyurethane, polyurea or polyurethane/polyurea which is selected for use as a component of the out-sole assembly 25 preferably has a Shore D hardness of from about 10 to about 60, more preferably from about 25 to about 60, and most preferably from about 30 to about 55 for a soft cover layer. The polyurethane, polyurea or polyurethane/polyurea which is to be used preferably has a flex modulus from about 1 to about 310 Kpsi, more preferably from about 5 to about 100 Kpsi, and most preferably from about 5 to about 20 Kpsi for a soft component and 30 to 70 Kpsi for a hard component.

Non-limiting examples of a polyurethane, polyurea or polyurethane/polyurea suitable for use include a thermoplastic polyester polyurethane such as Bayer Corporation's TEXIN® polyester polyurethane (such as TEXIN® DP7-1097, TEXIN® 285 and TEXIN® 245 grades).

According to Bayer Corporation, TEXIN® DP7-1097 has the following properties:

TABLE 1

Properties of TEXIN ® DP7-1097

| | |
|---|---|
| Tensile Strength (ASTM D412) | 6000 lb/in$^2$ |
| @50% (ASTM D412) | 875 lb/in$^2$ |
| @200% (ASTM D412) | 950 lb/in$^2$ |
| @300% (ASTM D412) | 2200 lb/in$^2$ |
| Ultimate Elongation (ASTM D412) | 450% |
| Flexural Modulus (ASTM D790) | |
| 158° F. (70° C.) | 3841 lb/in$^2$ |
| 73° F. (23° C.) | 6500 lb/in$^2$ |
| −22° F. (−30° C.) | 57400 lb/in$^2$ |
| Hardness (Shore A/Shore D) | 90/40 |
| Bayshore Resilience (ASTM D2632) | 35% |
| Solubility in Water | Insoluble |
| Tear Strength, Die "C" (ASTM D624) | 600 lbf/in |
| Specific Gravity (ASTM D792) | 1.20 |
| Vicat Softening Temp. (ASTM D1525) | 216° F. |
| Melt Index | 7-14 g/10 min at 200° C. and 8.7 kg, L/D = 4 (Method 1103-A) |

According to Bayer Corporation, TEXIN® 245 has the following properties:

TABLE 2

Properties of TEXIN ® 245

| | |
|---|---|
| Melt Flow | 20-40 (230° C., 1.2 kg load) |
| Hardness | 40-50 D |
| Tensile Strength | 4000 psi Minimum |
| 100% Modulus | 1090-1400 psi |

The melt indexes of the base thermoplastic polyurethanes received from Bayer Corporation are then increased to the following specifications:

TPU Melt Index ("MI") Specifications

A. DP7-1097
As received from Bayer Corporation: 7-14, measured at 20° C., 8.7 kg. load
"Refined" or extruded specification: 30-50, measured at 20° C., 8.7 kg. load
% flow increase: 114%-614%
B. TEXIN® 245
As received from Bayer Corporation: 20-40, measured at 23° C., 1.2 kg. load
"Refined" specification: 30-50, measured at 21° C., 8.7 kg. load
% flow increase: Approximately 100%

General TPU Extrusion Conditions dry material below 0.03% moisture
single screw extruder, with a single stage screw having an L/D of at least 24:1 and a compression ratio of 3:1
processing temps.
hopper: 180-220 F
rear: 360-390 F
middle: 360-400 F
front: 360-410 F
adapter: 365-410 F
die: 370-415 F
melt: 385-465 F
cushion-0.125" max.
back pressure-200 psi. max.
screw speed-40-80 rpm
screen packs-optional Procedure for Raising Melt Index ("M.I.") to Desired Refined Specification of 30-50

1. Measure M.I. of dried material as received from Bayer Corporation;
2. Adjust extruder machine settings to achieve a nominal M.I. 40, measured at the appropriate test conditions for either DP7-1097 or Texin 245; and
3. Periodically check the M.I. throughout the extrusion run to ensure a target M.I. value of 40.

Typically, there are two classes of thermoplastic polyurethane materials: aliphatic polyurethanes and aromatic polyurethanes. The aliphatic materials are produced from a polyol or polyols and aliphatic isocyanates, such as $H_{12}$MDI or HDI, and the aromatic materials are produced from a polyol or polyols and aromatic isocyanates, such as MDI or TDI. The thermoplastic polyurethanes may also be produced from a blend of both aliphatic and aromatic materials, such as a blend of HDI and TDI with a polyol or polyols.

Generally, the aliphatic thermoplastic polyurethanes are lightfast, meaning that they do not yellow appreciably upon exposure to ultraviolet light. Conversely, aromatic thermoplastic polyurethanes tend to yellow upon exposure to ultraviolet light. One method of stopping the yellowing of the aromatic materials is to paint the outer surface with a coating containing a pigment, such as titanium dioxide, so that the ultraviolet light is prevented from reaching the surface. Another method is to add UV absorbers and stabilizers to the clear coating, as well as to the thermoplastic polyurethane material itself. By adding UV absorbers and stabilizers to the thermoplastic polyurethane and the coating(s), aromatic polyurethanes can be effectively used. This is advantageous because aromatic polyurethanes typically have better scuff resistance characteristics than aliphatic polyurethanes, and the aromatic polyurethanes are typically lower cost than aliphatic polyurethanes.

Non-limiting examples of suitable RIM systems for use in the present invention are Bayflex® elastomeric polyurethane RIM systems, Baydur® GS solid polyurethane RIM systems, Prism® solid polyurethane RIM systems, all from Bayer Corp. (Pittsburgh, Pa.), SPECTRIM® reaction moldable polyurethane and polyurea systems from Dow Chemical USA (Midland, Mich.), including SPECTRIM® MM 373-A (isocyanate) and 373-B (polyol), and ELASTOLIT® SR systems from BASF (Parsippany, N.J.). Preferred RIM systems include BAYFLEX® MP-5000 and BAYFLEX® 110-50, filled and unfilled. Further preferred examples are polyols, polyamines and isocyanates formed by processes for recycling polyurethanes and polyureas. Additionally, these various systems may be modified by incorporating a butadiene component in the diol agent.

The isocyanate that is added to improve scuff resistance can be any aliphatic or aromatic isocyanate or diisocyanate or blends thereof known in the art. Examples of suitable isocyanates include, but are not limited to, 4,4'-diphenylmethane diisocyanate ("MDI"); 2,4-toluene diisocyanate ("TDI"); m-xylylene diisocyanate ("XDI"); methylene bis-(4-cyclohexyl isocyanate) ("HMDI"); hexamethylene diisocyanate ("HDI"); naphthalene-1,5,-diisocyanate ("NDI"); 3,3'-dimethyl-4,4'-biphenyl diisocyanate ("TODI"); 1,4-diisocyanate benzene ("PPDI"); phenylene-1,4-diisocyanate; and 2,2,4- or 2,4,4-trimethyl hexamethylene diisocyanate ("TMDI"). Other less preferred diisocyanates include, but are not limited to, isophorone diisocyanate ("IPDI"); 1,4-cyclohexyl diisocyanate ("CHDI"); diphenylether-4,4'-diisocyanate; p,p'-diphenyl diisocyanate; lysine diisocyanate ("LDI"); 1,3-bis (isocyanato methyl)cyclohexane; polymethylene polyphenyl isocyanate ("PMDI"); and meta-tetramethylxylylene diisocyanate ("TMXDI"). Preferably, the diisocyanate is MDI. The term "isocyanate" as used herein includes all of these compounds and other isocyanates.

As mentioned generally above, the isocyanate or diisocyanate used may have a solids content in the range of about 1 to about 100 weight %, preferably about 5 to about 50 weight %, most preferably about 10 to about 30 weight %. If it is necessary to adjust the solids content, any suitable solvent (such as ketone and acetate) that will allow penetration of the isocyanate into the polyurethane material without causing distortion may be used.

More preferably, the isocyanate utilized is MONDUR ML™, an aromatic diisocyanate manufactured by the Bayer Corporation. According to Bayer, MONDUR ML™ is an isomer mixture of diphenyl methane diisocyanate (MDI) containing a high percentage of 2,4 isomer. More particularly, MONDUR ML™ reportedly has the following specifications and proportions:

A. Product Specifications

| | | | |
|---|---|---|---|
| Assay, wt. % | 99.5 minimum | 2',4' isomer content, % | 50-60 |
| Acidity as HCl, ppm | 30 maximum | Dimer, wt. % | 0.3 maximum |

B. Typical Properties*

| | | | |
|---|---|---|---|
| Appearance | Clear to light yellow liquid | Specific Gravity @ 25° C. | 1.19 |
| Equivalent weight | 125 | Freezing point | 59°-68° F. (15-20° C.) |
| NCO Content, % | 33.4-33.6 | | |
| Viscosity @ 25° C., mPa * s | 10 | Flash point (Setaflash) | 388° F. (198° C.) |
| Weight per gallon, lb. @ 25° C. | 9.9 | Equivalent wt., avg. (as supplied) | 125 |

*These items are provided as general information only. They are approximate values and are not considered part of the product specification.

The isocyanate is preferably added by dipping, soaking or spraying in or with the isocyanate solution for about 1 to 10 minutes, more preferably about 1 to 5 minutes. The isocyanate solution may be any desired isocyanate or diisocyanate solution, and the solids content is preferably 1 to 100 weight percent, preferably 5 to 50 weight percent, more preferably 15 to 30 weight percent, and most preferably 16 to 24 weight percent. The components of the out-sole assembly 25 are preferably heated to a temperature such as 110° F. to 120° F. before adding the isocyanate to facilitate the penetration of the isocyanate into the material, although heating is not required. After the components of the out-sole assembly 25 are dipped in the isocyanate solution for the appropriate amount of time, the components of the out-sole assembly 25 are air dried for approximately 30 minutes to 24 hours, more preferably 1 to 2 hours, and most preferably at least about 1 hour. The components of the out-sole assembly 25 are then post-cured to promote cross-linking of the material, preferably at a temperature of about 150° F. to 250° F., more preferably about 175° F. for about 2 to 24 hours, more preferably about 4 hours. After post-curing, the components of the out-sole assembly 25 may be cleaned using a suitable cleaner, such as an alcohol, if needed. An example of a suitable alcohol is isopropanol, although any suitable alcohol that does not damage or react with the material may be used. After addition of the isocyanate, the components of the out-sole assembly 25 finished as desired.

The procedure for dipping was further refined for production to improve efficiency and reduce the processing time. The components of the out-sole assembly 25 could be oven dried for only 4 hours at 175° F. instead of 16 hours at 180° F., and the isopropanol rinse could be eliminated without adversely affecting the scuff results.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. An outsole assembly for a golf shoe comprising:

an internal base member composed of ethylene vinyl acetate, the internal base member having a thickness ranging from 5 mm to 30 mm;

an inner frame member composed thermoplastic polyurethane subjected to an isocyanate solution;

an external base member composed of a thermoplastic polyurethane;

a dual looping frame composed of a thermoplastic polyurethane, the dual looping frame comprising a plurality of traction teeth; and a plurality of spike members.

2. A golf shoe comprising:

an internal base member;

an inner frame member;

an external base member;

a dual looping frame, the dual looping frame comprising a plurality of teeth, each of the plurality of traction teeth having a height ranging from 1 mm to 6 mm; and a plurality of spike members;

wherein at least one of the components above is molded from a thermoplastic material comprising a polyurethane, polyurea or polyurethane/polyurea composition having a melt index of 15 g/10 min or more at a temperature of 200° C. to 210° C. and a load of 8.7 kg prior to molding, and wherein the component is treated with a secondary curing agent comprising an isocyanate subsequent to molding.

3. The golf shoe according to claim 2 wherein each of a plurality of the components is molded from a thermoplastic material comprising a polyurethane, polyurea or polyurethane/polyurea composition having a melt index of 15 g/10 min or more at a temperature of 200° C. to 210° C. and a load of 8.7 kg prior to molding, and wherein the component is treated with a secondary curing agent comprising an isocyanate subsequent to molding.

4. A golf shoe comprising:

an internal base member, the internal base member having a thickness ranging from 5 mm to 30 mm;

an inner frame member;

an external base member;

a dual looping frame, the dual looping frame comprising a plurality of teeth, each of the plurality of traction teeth having a height ranging from 1 mm to 6 mm; and a plurality of spike members;

wherein at least one of the components above has a Shore D hardness of 60 or less and is molded from a thermoplastic material comprising a polyurethane, polyurea or polyurethane/polyurea composition having a flex modulus of 30,000 psi or less and a melt index of 15 g/10 min or more at a temperature of 200° C. to 210° C. and a load of 8.7 kg prior to molding, and wherein the component is treated with a secondary curing agent comprising an isocyanate subsequent to molding.

5. The golf shoe according to claim 3 wherein said isocyanate is selected from the group consisting of 4,4'-diphenylmethane diisocyanate ("MDI"); 2,4-toluene diisocyanate ("TDI"); m-xylylene diisocyanate ("XDI"); methylene bis-(4-cyclohexyl isocyanate) ("HMDI"); hexamethylene diisocyanate ("HDI"); naphthalene-1,5,-diisocyanate ("NDI"); 3,3'-dimethyl-4,4'-biphenyl diisocyanate ("TODI"); 1,4-diisocyanate benzene ("PPDI"); phenylene-1,4-diisocyanate; 2,2,4- or 2,4,4-trimethyl hexamethylene diisocyanate ("TMDI"); isophorone diisocyanate ("IPDI"); 1,4-cyclohexyl diisocyanate ("CHDI"); diphenylether-4,4'-diisocyanate; p,p'-diphenyl diisocyanate; lysine diisocyanate ("LDI"); 1,3-bis(isocyanato methyl)cyclohexane; polymethylene polyphenyl isocyanate ("PMDI"); meta-tetramethylxylylene diisocyanate ("TMXDI"); and combinations thereof.

6. The golf shoe according to claim 2 wherein each of a plurality of the components has a Shore D hardness of 60 or less and is molded from a thermoplastic material comprising a polyurethane, polyurea or polyurethane/polyurea composition having a flex modulus of 30,000 psi or less and a melt index of 15 g/10 min or more at a temperature of 200° C. to 210° C. and a load of 8.7 kg prior to molding, and wherein the component is treated with a secondary curing agent comprising an isocyanate subsequent to molding.

7. The golf shoe according to claim 4 further comprising a mid-sole and an upper with an opening.

* * * * *